US009453668B2

(12) United States Patent
Higashiiue et al.

(10) Patent No.: US 9,453,668 B2
(45) Date of Patent: Sep. 27, 2016

(54) REFRIGERATION CYCLE APPARATUS AND REFRIGERANT CIRCULATING METHOD

(75) Inventors: Shinya Higashiiue, Tokyo (JP); So Nomoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 599 days.

(21) Appl. No.: 13/825,988

(22) PCT Filed: Jan. 26, 2011

(86) PCT No.: PCT/JP2011/051383

§ 371 (c)(1),
(2), (4) Date: Mar. 26, 2013

(87) PCT Pub. No.: WO2012/053229

PCT Pub. Date: Apr. 26, 2012

(65) Prior Publication Data

US 2013/0213083 A1 Aug. 22, 2013

(30) Foreign Application Priority Data

Oct. 18, 2010 (JP) ..... 2010-233813

(51) Int. Cl.
*F25B 1/00* (2006.01)
*F25B 19/02* (2006.01)
(Continued)

(52) U.S. Cl.
CPC ..... *F25B 41/04* (2013.01); *F25B 5/04* (2013.01); *F25B 41/00* (2013.01); *F25B 2341/0011* (2013.01); *F25B 2341/0013* (2013.01); *F25B 2400/16* (2013.01)

(58) Field of Classification Search
CPC ..... F25B 2341/0011; F25B 2341/0013; F25B 2400/16; F25B 41/00; F25B 41/04
USPC ..... 62/500, 115, 116, 170, 191, 515
See application file for complete search history.

(56) References Cited

U.S. PATENT DOCUMENTS

2004/0040340 A1* 3/2004 Takeuchi et al. ..... 62/500
2004/0103685 A1* 6/2004 Yamaguchi et al. ..... 62/500
(Continued)

FOREIGN PATENT DOCUMENTS

CN 1657844 A 8/2005
JP 2001-263830 A 9/2001
(Continued)

OTHER PUBLICATIONS

Office Action dated Oct. 22, 2014 issued in corresponding CN patent application No. 201180050218.2 (and English translation).
(Continued)

*Primary Examiner* — Henry Crenshaw
(74) *Attorney, Agent, or Firm* — Posz Law Group, PLC

(57) ABSTRACT

In a refrigeration cycle apparatus, a compressor, a condenser, a first flow control valve, a refrigerant storage container, a second flow control valve, and a first evaporator are connected in this order, and a third flow control valve, an ejector, a second evaporator, and the compressor are connected in this order so as to branch from an outlet of the condenser. A driving refrigerant inlet of the ejector is connected to the third flow control valve, a suction refrigerant inlet of the ejector is connected to an outlet of the first evaporator, and a mixed refrigerant outlet of the ejector is connected to a refrigerant inlet of the second evaporator. The refrigeration cycle apparatus has a bypass circuit which branches from a refrigerant pipe connecting the condenser and the second flow control valve and is connected to the mixed refrigerant outlet of the ejector via a fourth flow control valve.

16 Claims, 14 Drawing Sheets

(51) Int. Cl.

| | |
|---|---|
| ***F25B 1/06*** | (2006.01) |
| ***F25B 41/00*** | (2006.01) |
| ***F25B 41/04*** | (2006.01) |
| ***F25B 5/04*** | (2006.01) |

(56) References Cited

U.S. PATENT DOCUMENTS

| | | | | |
|---|---|---|---|---|
| 2005/0178150 | A1 | 8/2005 | Oshitani et al. | |
| 2006/0156745 | A1* | 7/2006 | Ikegami et al. | 62/170 |
| 2006/0254308 | A1* | 11/2006 | Yokoyama et al. | 62/500 |
| 2007/0000262 | A1* | 1/2007 | Ikegami et al. | 62/170 |
| 2007/0039349 | A1* | 2/2007 | Yamada et al. | 62/500 |
| 2007/0186572 | A1* | 8/2007 | Nishida et al. | 62/170 |
| 2008/0034770 | A1* | 2/2008 | Al-Azmi et al. | 62/199 |
| 2009/0216377 | A1* | 8/2009 | Lee et al. | 700/275 |

FOREIGN PATENT DOCUMENTS

| | | | | | |
|---|---|---|---|---|---|
| JP | 2003-279177 | A | | 10/2003 | |
| JP | 2005-308380 | A | | 11/2005 | |
| JP | 2005308380 | A | * | 11/2005 | F25B 1/00 |
| JP | 2006-132875 | A | | 5/2006 | |
| JP | 2007-78340 | A | | 3/2007 | |
| JP | 2008-111662 | A | | 5/2008 | |
| JP | 2009-2649 | A | | 1/2009 | |
| JP | 2010-2134 | A | | 1/2010 | |

OTHER PUBLICATIONS

Office Action dated May 21, 2015 issued in corresponding CN patent application No. 201180050218.2 (and English translation).

International Search Report of the International Searching Authority mailed Mar. 8, 2011 for the corresponding international application No. PCT/JP2011/051383 (with English translation).

* cited by examiner

REFRIGERATION CYCLE APPARATUS AND REFRIGERANT CIRCULATING METHOD

CROSS REFERENCE TO RELATED APPLICATIONS

This application is a U.S. national stage application of PCT/JP2011/051383 filed on Jan. 26, 2011, and claims priority to, and incorporates by reference, Japanese Patent Application No. 2010-233813 filed on Oct. 18, 2010.

TECHNICAL FIELD

The invention relates to a refrigeration cycle apparatus including an ejector for achieving a high-efficiency operation of a heat pump.

BACKGROUND ART

In an existing refrigeration cycle apparatus including an ejector, a variable throttle mechanism 31 is mounted at an outlet of a condenser 12, a fixed throttle 19 is mounted on one of branching paths on the downstream side of the variable throttle mechanism 31, and an ejector 15 is mounted on the other branching path (e.g., see Patent Literature 1).

Flow rates of a refrigerant passing through the fixed throttle 19 and a nozzle 15*a* of the ejector 15 are previously set to provide such an optimum flow ratio that the cooling capacity of the entire system is at its maximum, and this is achieved by setting the refrigerant flow passage area of the nozzle portion 15*a* of the ejector 15, the dimensions of a mixing portion 15*c* and a diffuser portion 15*d*, and the opening degree of the fixed throttle 19 to appropriate values.

CITATION LIST

Patent Literature

Patent Literature 1: Japanese Unexamined Patent Application Publication No. 2009-2649 (FIG. 2)

SUMMARY OF INVENTION

Technical Problem

However, in the case of a configuration as in the existing example, the pressure of the refrigerant flowing into the ejector 15 is reduced by the variable throttle mechanism provided on the ejector's upstream side. Thus, expansion power collected by the ejector 15 is reduced. As a result, the effect of improving the efficiency of a refrigeration cycle by the ejector is not sufficiently obtained.

In addition, in order to maximize the amount of the expansion power collected by the ejector 15, the flow passage area of the nozzle portion 15*a* and the flow passage area of the fixed throttle 19 are preferably determined in a state where the variable throttle mechanism 13 is fully opened. However, there is a problem that when the amount of the circulating refrigerant is increased by increase in a cooling load, the flow passage areas of the fixed throttle 19 and the nozzle 15*a* of the ejector 15 become excessively small, the difference between the highest pressure and the lowest pressure in the refrigeration cycle broadens, and the operation is deviated from an optimum operating state in which COP is at its maximum.

It is an object of the invention to provide a refrigeration cycle apparatus which uses an ejector and has high operating efficiency.

Solution to Problem

A refrigeration cycle apparatus of the invention is a refrigeration cycle apparatus, for circulating a refrigerant, including an ejector having a driving refrigerant inlet into which a driving refrigerant flows, a suction refrigerant inlet into which a suction refrigerant flows, and a mixed refrigerant outlet through which a mixed refrigerant which is a mixture of the driving refrigerant and the suction refrigerant flows out. The refrigeration cycle apparatus includes:

a first refrigerant path in which a compressor, a radiator, a flow control valve, and a first evaporator are connected in this order via pipes and a refrigerant outlet of the first evaporator is connected to the suction refrigerant inlet of the ejector via a pipe;

a second refrigerant path in which the compressor and a second evaporator are connected in this order via a pipe and a refrigerant inlet of the second evaporator is connected to the mixed refrigerant outlet of the ejector via a pipe;

a third refrigerant path which branches from a branch portion in a middle of a pipe connecting a refrigerant outlet of the radiator and the flow control valve in the first refrigerant path and is connected to the driving refrigerant inlet of the ejector via a pipe; and a bypass which branches from an upstream side of the flow control valve in the first refrigerant path on a downstream side of the branch portion on the first refrigerant path and is connected between the mixed refrigerant outlet of the ejector and the second evaporator via a pipe in the second refrigerant path and on which a bypass flow control unit is provided which controls a flow rate of the refrigerant.

Advantageous Effects of Invention

According to the present invention, a refrigeration cycle apparatus which uses an ejector and has high operating efficiency can be provided.

DESCRIPTION OF EMBODIMENTS

Embodiment 1

Figure 1:
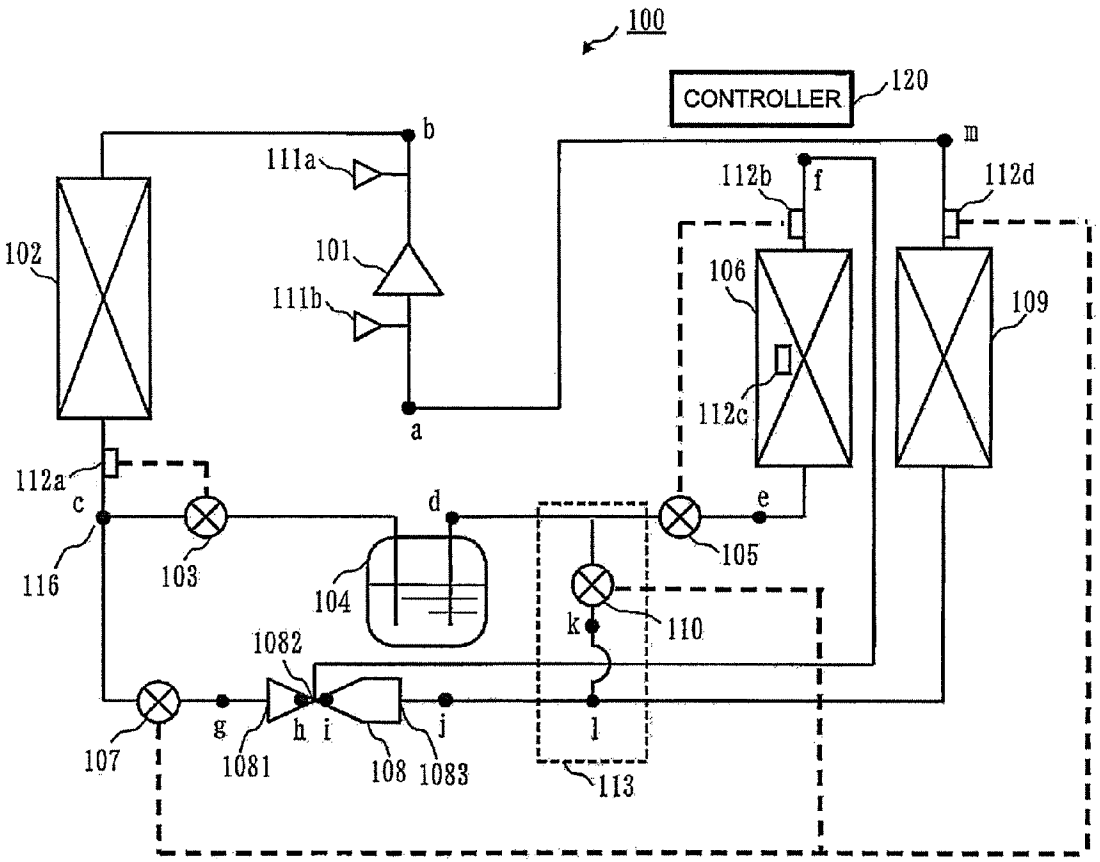
FIG. 1 is a schematic diagram of a refrigeration cycle apparatus 100 of Embodiment 1.

FIG. 1 is a schematic diagram showing the configuration of a refrigeration cycle apparatus 100 according to Embodiment 1. The refrigeration cycle apparatus 100 includes an ejector 108.

(1) The refrigeration cycle apparatus 100 has a first refrigerant path in which a compressor 101, a condenser 102 which is a radiator, a first flow control valve 103, a refrigerant storage container 104 which stores an excess refrigerant, a second flow control valve 105 (a flow control valve), and a first evaporator 106 are connected in this order via refrigerant pipes and a refrigerant outlet of the first evaporator 106 is connected to a suction refrigerant inlet 1082 of the ejector 108 via a pipe.

(2) In addition, the refrigeration cycle apparatus 100 has a second refrigerant path in which the compressor 101 and a second evaporator 109 are connected via a refrigerant pipe and a refrigerant inlet of the second evaporator 109 is connected to a mixed refrigerant outlet 1083 of the ejector 108 via a refrigerant pipe.

(3) Moreover, the refrigeration cycle apparatus 100 has a third refrigerant path which branches from a branch portion 116 in the middle of a pipe connecting a refrigerant outlet of the condenser 102 and the second flow control valve 105 in the first refrigerant path and is connected to a driving refrigerant inlet 1081 of the ejector 108 via a pipe. On the third refrigerant path, a third flow control valve 107 (an example of a driving flow control unit) is provided.

(4) Furthermore, the refrigeration cycle apparatus 100 has a bypass circuit 113 which branches from the upstream side of the second flow control valve 105 in the first refrigerant path on the downstream side of the branch portion 116 and is connected between the mixed refrigerant outlet 1083 of the ejector 108 and the second evaporator 109 via a pipe in the second refrigerant path and on which a fourth flow control valve 110 (a bypass flow control unit) is provided which controls a flow rate of the refrigerant. The bypass circuit 113 is a feature of the refrigeration cycle apparatus 100.

(5) In addition, the refrigeration cycle apparatus 100 includes a controller 120.

(Various Detectors)

On each pipe through which the refrigerant circulates, each detector (sensor) is mounted. Specifically, pressure detectors 111*a* and 111*b* which measure discharge and suction pressures of the compressor 101, a temperature detector 112*a* which detects a temperature at the outlet of the condenser 102, temperature detectors 112*b* and 112*c* which detect a temperature at the outlet of the first evaporator 106 and a temperature at the middle of the first evaporator 106, a temperature detector 112*d* which detects a suction temperature of the compressor 101, and the like are mounted. Detection signals from these detectors are collected by the controller 120. Then, various signals are processed by processing means provided in a processing section (not shown) within the controller 120, and are compared/determined on the basis of respective target values (e.g., temperature, degree of superheat, and degree of subcooling), and then control instruction values are transmitted from a control signal transmission section (not shown) within the controller 120 to various actuators (e.g., the flow control valves and the compressor). The controller 120 controls various actuators. The opening degrees of the first flow control valve 103, the second flow control valve 105, the third flow control valve 107, and the fourth flow control valve 110 shown in FIG. 1 are controllable under control of the controller 120. In addition, the operating frequency of the compressor 101 is controllable under control of the controller 120. Control described below with reference to the flowcharts in FIGS. 6 to 9 is all performed by the controller 120. Each dashed line connecting a detector and a flow control valve in FIG. 1 and FIG. 13 indicates the relationship between the detector and the flow control valve which is controlled on the basis of a detection result. For example, in the case of FIG. 1, the first flow control valve 103 is controlled on the basis of a detection result of the temperature detector 112*a*.

(Configuration of Ejector 108)

Figure 2:
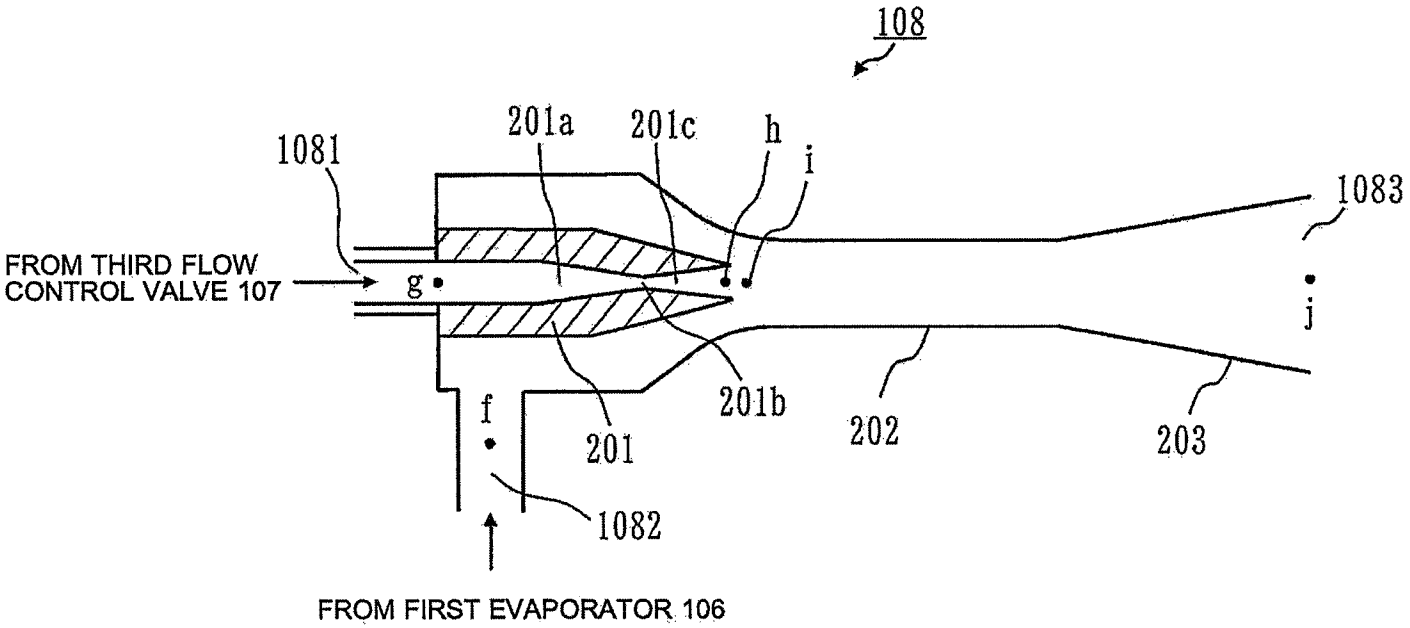
FIG. 2 is a schematic diagram showing the internal structure of an ejector 108 of Embodiment 1.

FIG. 2 is a diagram showing the internal structure of the ejector 108. The ejector 108 includes a nozzle portion 201, a mixing portion 202, and a diffuser portion 203. The nozzle portion 201 includes a throttle portion 201*a*, a throat portion 201*b*, and a spreading-out portion 201*c*. In the ejector 108, a high-pressure refrigerant (a driving refrigerant) flowing out from the condenser 102 flows in through the driving refrigerant inlet 1081, the flowing-in driving refrigerant is reduced in pressure to be expanded in the throttle portion 201*a*, and its speed is made to reach a sonic speed in the nozzle throat portion 201*b* and further to reach a supersonic speed in the spreading-out portion 201*c*, resulting in that the driving refrigerant is reduced in pressure and accelerated. Thus, the ultrahigh-speed two-phase gas-liquid refrigerant flows out from the nozzle portion 201. Meanwhile, a refrigerant in the suction refrigerant inlet 1082 (a suction refrigerant) is drawn by the ultrahigh-speed refrigerant flowing out from the nozzle portion 201. At an outlet of the nozzle portion 201, that is, at an inlet of the mixing portion 202, the ultrahigh-speed driving refrigerant and the low-speed suction refrigerant start being mixed with each other, and the pressure is restored (increased) by momentum exchange therebetween. Furthermore, in the diffuser portion 203 as well, the pressure is restored by deceleration caused by flow path enlargement, and a mixed refrigerant which is a mixture of the driving refrigerant and the suction refrigerant flows out through the mixed refrigerant outlet 1083 of the diffuser portion 203.

(Operation)

Next, an operation will be described.

Figure 3:
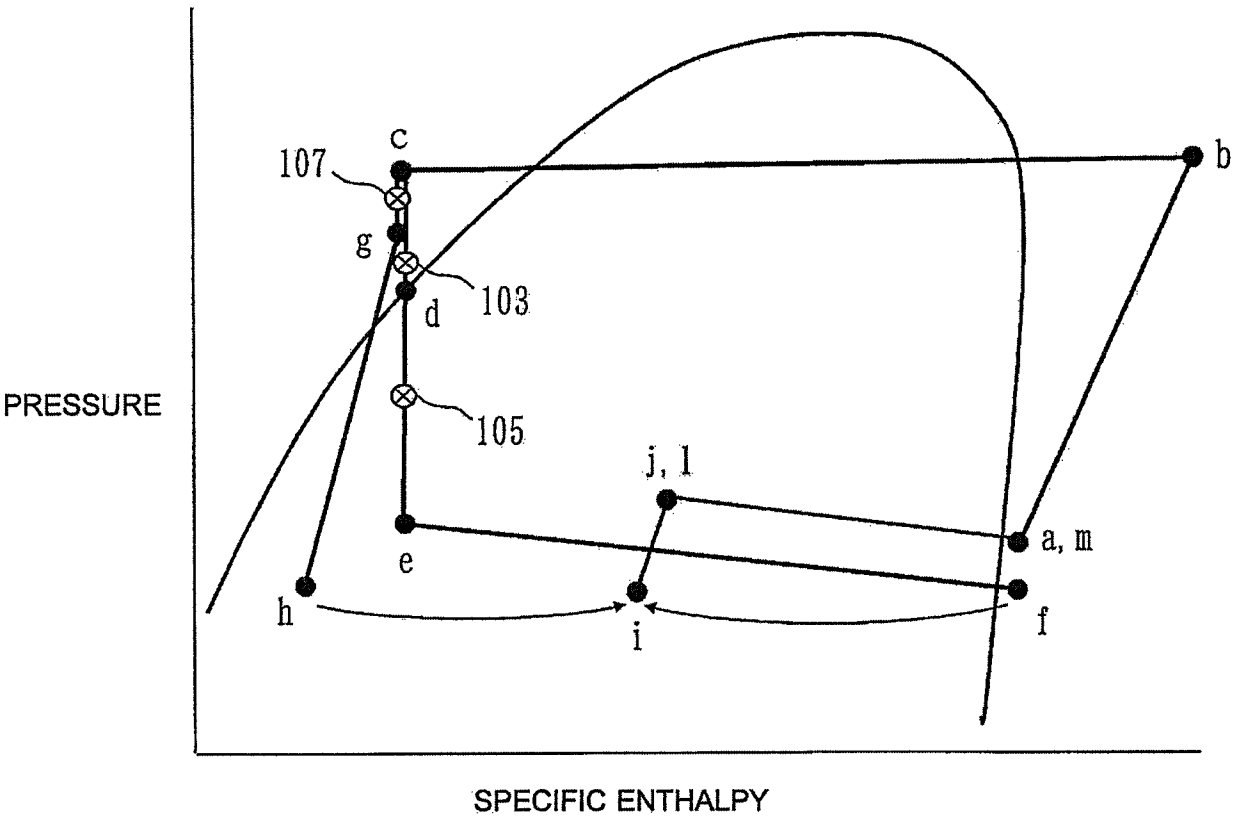
FIG. 3 is a Mollier diagram of Embodiment 1.

FIG. 3 shows a case where the bypass circuit 113 is not used, that is, a Mollier diagram which is the assumption of Embodiment 1. In the Mollier diagram in FIG. 3, the horizontal axis indicates the specific enthalpy of the refrigerant, and the vertical axis indicates a pressure. In the diagram, each of points a to m indicates a refrigerant state in each pipe in the schematic diagram of the refrigeration cycle apparatus shown in FIG. 1.

A low-pressure refrigerant in a state a at an inlet of the compressor 101 becomes a high-temperature and high-pressure gaseous refrigerant (state b) by the compressor 101, flows into the condenser 102, and is cooled by heat exchange with outside air to become a state c. The refrigerant in the state c is divided into a refrigerant flowing to the driving refrigerant inlet 1081 of the ejector 108 and a refrigerant flowing to the first flow control valve 103. The refrigerant having flowed to the first flow control valve 103 is reduced in pressure and then flows into the refrigerant storage container 104. In the refrigerant storage container 104, a liquid refrigerant having a high density stays at the container bottom, and a gaseous refrigerant stays at the container upper portion. The refrigerant in a state d flowing out from the refrigerant storage container 104 is reduced in pressure by the second flow control valve 105 to become a state e, and flows into the first evaporator 106. The refrigerant is heated by heat exchange from a cooling space in the first evaporator 106 to become a state f, and flows to the suction refrigerant inlet 1082 of the ejector 108.

On the other hand, the refrigerant in the state c divided from the condenser 102 and having flowed to the third flow control valve 107 is reduced in pressure by the third flow control valve 107 to become a state g, and flows into the ejector 108. The ultrahigh-speed refrigerant in a state h reduced in pressure by the nozzle portion 201 of the ejector 108 is mixed with the suction refrigerant, that is, the refrigerant in a state f having flowed out from the first evaporator 106, immediately after the outlet of the nozzle portion 201, to become a state i. The refrigerant is increased in pressure by the mixing portion 202 and the diffuser portion 203 of the ejector 108 to become a state j, and flows out through the mixed refrigerant outlet 1083 of the ejector 108.

The refrigerant in the state j becomes a state m by heat exchange with a cooling space at the second evaporator 109, and is sucked to the compressor 101. By the above-described operation, a refrigeration cycle is formed.

In order to maximize expansion power, the third flow control valve 107 is preferably operated in a fully-opened state. In an operating state in which the cooling load is low and the amount of the circulating refrigerant is small, when the fourth flow control valve 110 is closed; the flow rate of the refrigerant into the first evaporator 106 is adjusted by the first flow control valve 103; and the flow rate of the refrigerant into the ejector 108 is adjusted by the third flow control valve 107, a working state of the refrigeration cycle in which the operating efficiency is high can be obtained.

Figure 4:
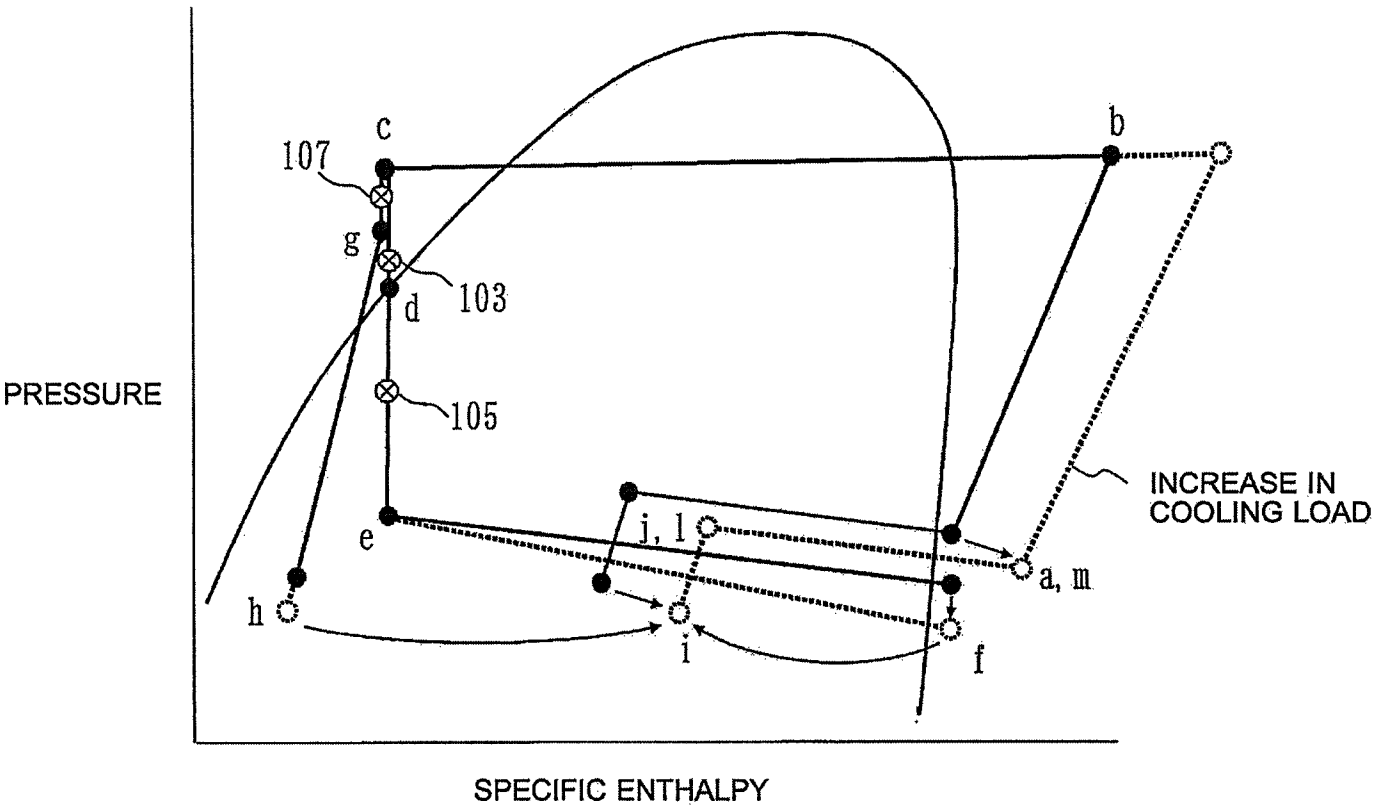
FIG. 4 is another Mollier diagram of Embodiment 1.

FIG. 4 is another Mollier diagram. The flow passage area of the nozzle throat portion 201*b* of the ejector 108 has a fixed value. Thus, when the cooling load is increased and the amount of the circulating refrigerant is increased, the flow rate of the refrigerant into the ejector 108 is excessively low, and the flow rate of the refrigerant into the first evaporator 106 is excessively high. As a result, regarding the working state of the refrigeration cycle, the points a, f, i, j, l, and m shift to lower right of the Mollier diagram as indicated by dashed lines in FIG. 4, thus the suction pressure of the compressor 101 is decreased and the operating efficiency of the refrigeration cycle is decreased.

Figure 5:
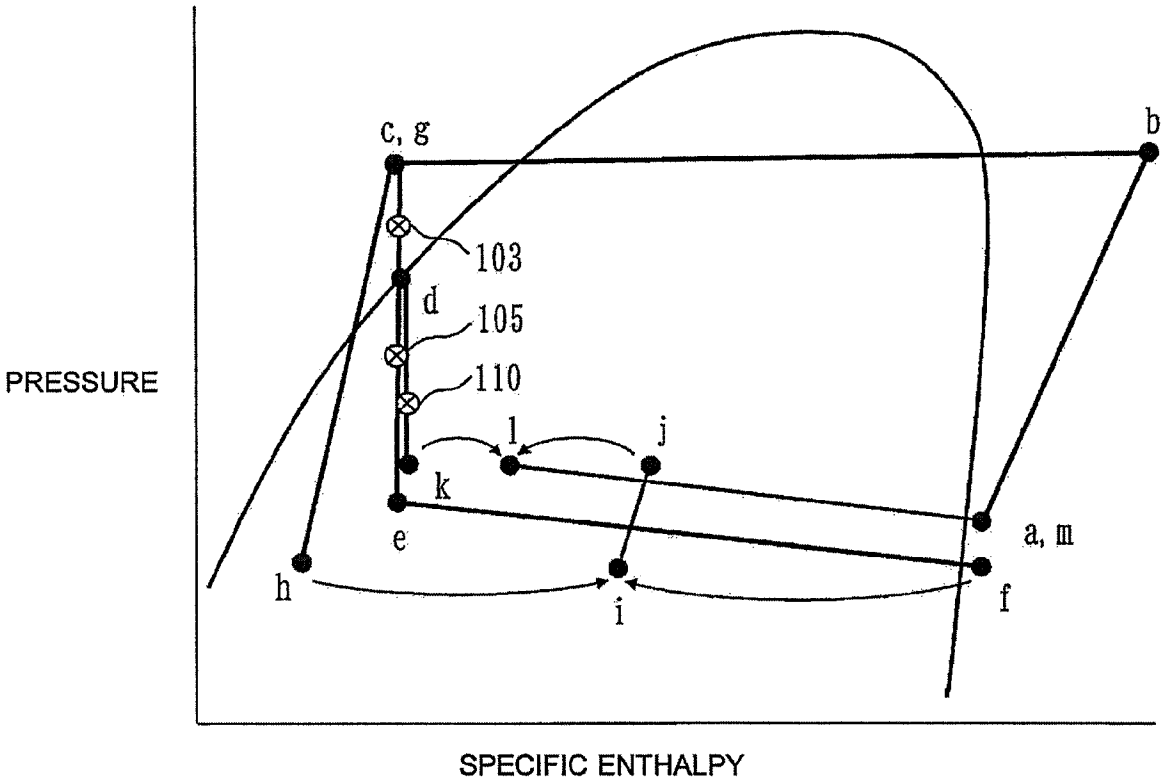
FIG. 5 is still another Mollier diagram of Embodiment 1.

FIG. 5 is still another Mollier diagram. Next, an operation using the bypass circuit 113 which is Embodiment 1 will be described with reference to the Mollier diagram in FIG. 5. The low-pressure refrigerant in the state a at the inlet of the compressor 101 becomes a high-temperature and high-pressure gaseous refrigerant (state b) by the compressor 101, flows into the condenser 102, and is cooled by heat exchange with outside air to become a state c. The refrigerant in the state c is divided into a refrigerant flowing to the driving refrigerant inlet 1081 of the ejector 108 and a refrigerant flowing to the first flow control valve 103. The refrigerant having flowed to the first flow control valve 103 is reduced in pressure and then flows into the refrigerant storage container 104. The refrigerant in a state d having flowed out from the refrigerant storage container 104 is divided into refrigerants flowing to the bypass circuit 113 and the second flow control valve 105. The refrigerant flowing to the second flow control valve 105 flows into the suction refrigerant inlet 1082 through the first evaporator 106, similarly in the operation described with reference to FIG. 3. On the other hand, the refrigerant flowing to the bypass circuit 113 is adjusted in its flow rate by the fourth flow control valve 110 to be reduced in pressure (state k), and is mixed with the refrigerant in a state j flowing out from the ejector 108, to become a state I. The refrigerant in the state I is sucked to the compressor 101 through the second evaporator 109.

The enthalpy of the mixed refrigerant outlet 1083 of the ejector 108 can be decreased by the use of the bypass circuit 113. Thus, the points a, f, i, j, l, and m indicated by the dashed lines in FIG. 4 can be made into appropriate states, and the efficiency of the refrigeration cycle can be increased.

(Control)

Next, control of each flow control valve will be described. As described above, the control of each flow control valve is performed by the controller 120.

Figure 6:
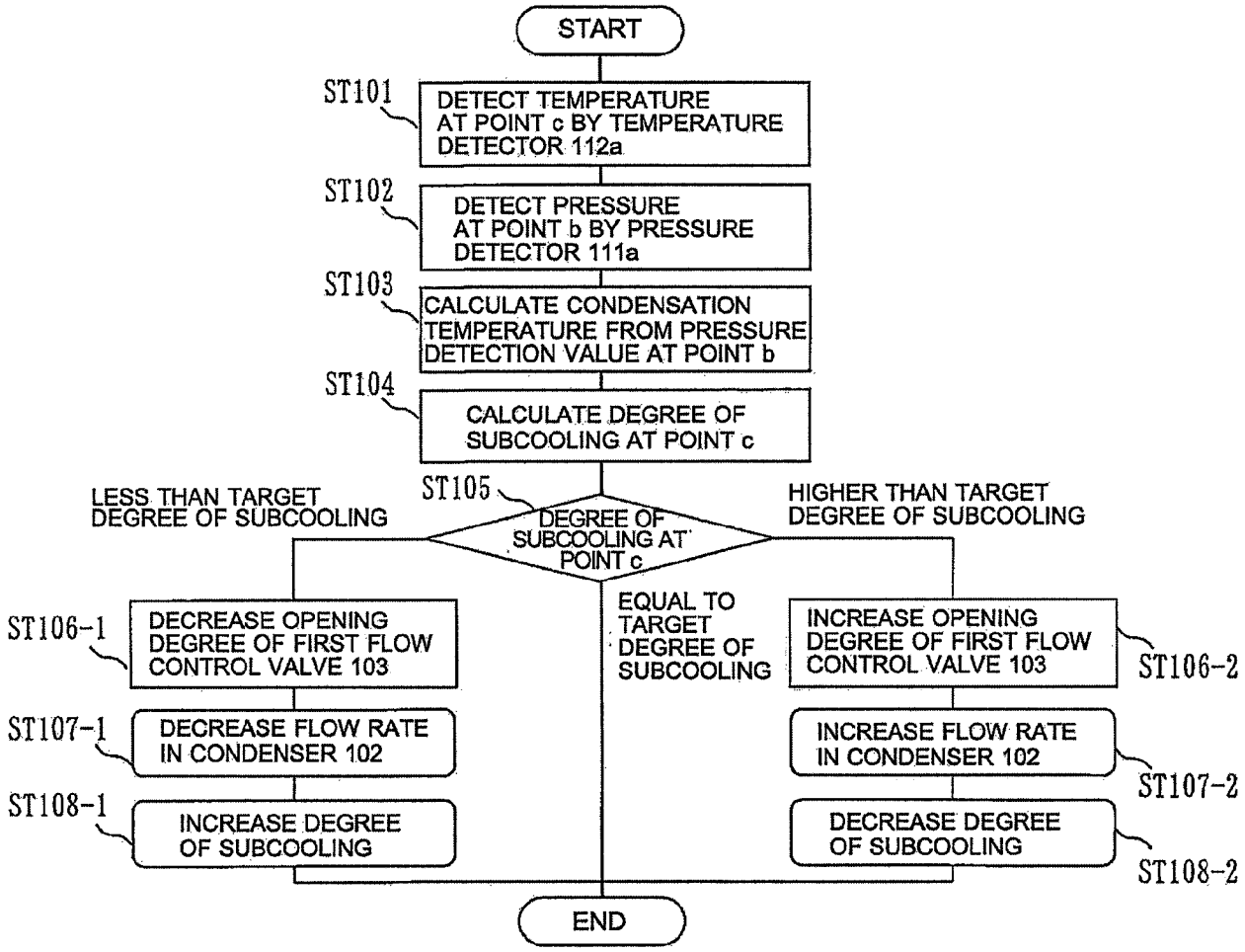
FIG. 6 is a control flow diagram of a first flow control valve 103 of Embodiment 1.

FIG. 6 is a diagram showing a control flow of the first flow control valve 103 by the controller 120. The control flow will be described with reference to FIG. 6 with, as an example, the case where a control target value for the first flow control valve 103 is a degree of subcooling at the outlet of the condenser 102. The degree of subcooling means the temperature difference between the saturation temperature of the refrigerant and the refrigerant temperature.

At ST101, the temperature of the refrigerant in the state c is detected by the temperature detector 112*a* mounted at the outlet of the condenser 102. At ST102, the pressure in the state b is detected by the pressure detector 111*a* mounted on the discharge pipe of the compressor 101. At ST103, the saturation temperature of the refrigerant is calculated from the pressure detection value at ST102. At ST104, a degree of subcooling in the state c is calculated from the calculated value of the refrigerant saturation temperature at ST103 and the detection value of the temperature at the outlet of the condenser 102. The calculated value of the degree of subcooling is determined at ST105 and the opening degree of the first flow control valve 103 is controlled.

If the calculated value of the degree of subcooling is lower than the target value, the opening degree of the first flow control valve 103 is decreased at ST106-1 to decrease the refrigerant flow rate (ST107-1) to increase the degree of subcooling (ST108-1). If the calculated value of the degree of subcooling is higher than the target value, the opening degree of the first flow control valve is increased at ST106-2 to increase the refrigerant flow rate (ST107-2) to decrease the degree of subcooling (ST108-2). ST101 to ST108 are periodically repeated to control the degree of subcooling in the state c at the outlet of the condenser 102. The target value for the degree of subcooling is previously set to such a value that the operating efficiency of the refrigeration cycle is at its maximum.

In the above description, the saturation temperature of the refrigerant is calculated from the pressure detector mounted at the outlet of the compressor 101, but the pressure detector is not limited thereto and may be mounted at the outlet or the inlet of the condenser 102. In addition, the temperature detector may be mounted at a position where the refrigerant is in a saturation state, and may directly detect the saturation temperature.

Figure 7:
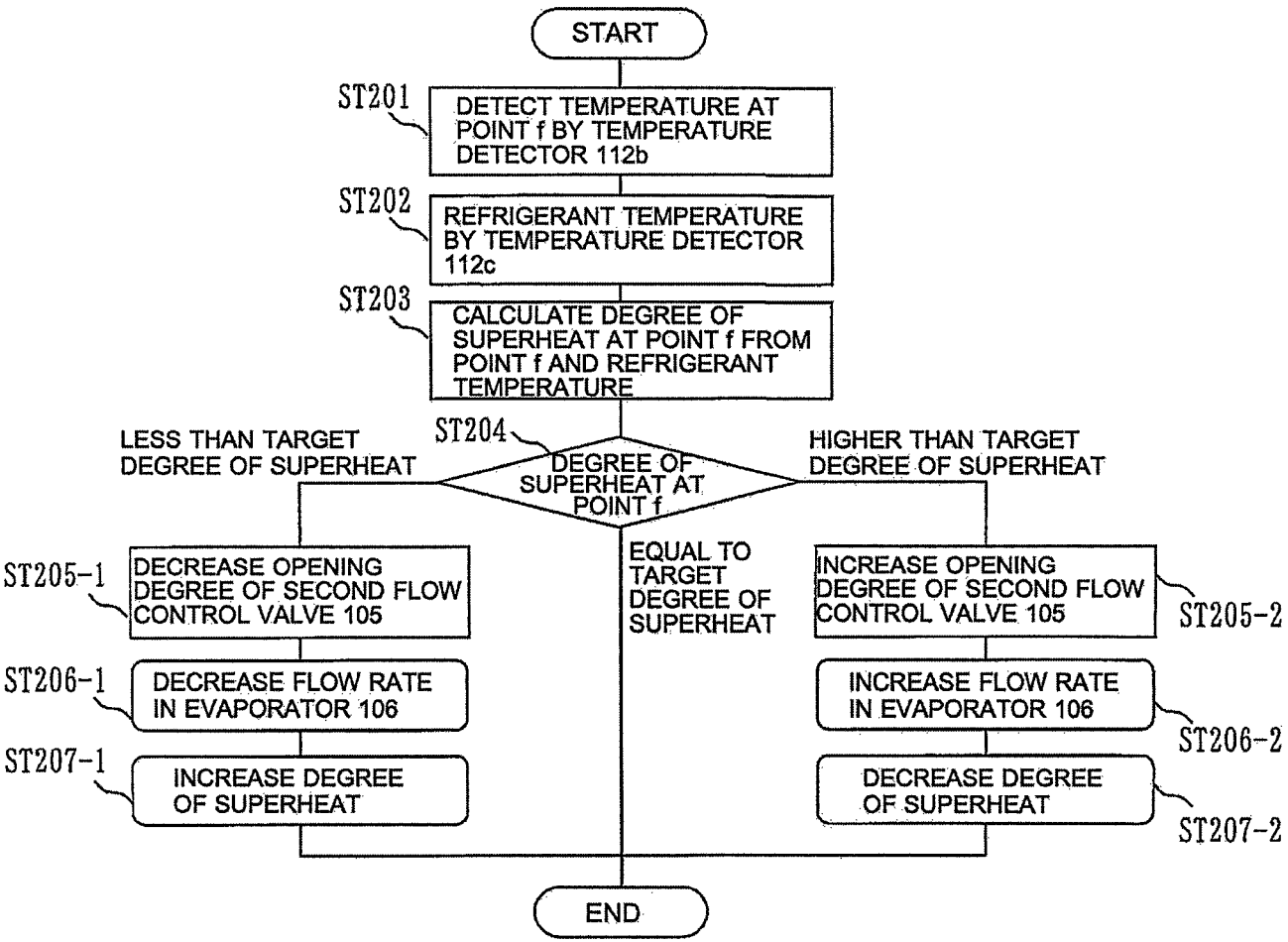
FIG. 7 is a control flow diagram of a second flow control valve 105 of Embodiment 1.

FIG. 7 is a diagram showing a control flow of the second flow control valve 105 by the controller 120. Next, control of the second flow control valve 105 will be described. The control flow will be described with reference to FIG. 7 with, as an example, the case where a control target value for the second flow control valve 105 is a degree of superheat at the outlet of the first evaporator 106. The degree of superheat means the difference between the refrigerant temperature and the saturation temperature of the refrigerant.

At ST201, the temperature of the refrigerant in the state f is detected by the temperature detector 112*b* mounted at the outlet of the first evaporator 106. At ST202, the temperature at the middle of the first evaporator 106 is detected by the temperature detector 112*c*. Since the refrigerant within the first evaporator 106 is in a two-phase gas-liquid saturation state, a detection value of the temperature of the heat exchanger middle portion per se can be used as the saturation temperature of the refrigerant. At ST203, the controller 120 calculates the degree of superheat at the outlet of the first evaporator 106 from the temperature detector values detected at ST201 and ST202. The controller 120 determines the calculated value of the degree of superheat at ST204 and controls the opening degree of the second flow control valve 105.

If the calculated value of the degree of superheat is lower than the target value, the controller 120 decreases the opening degree of the second flow control valve 105 at ST205-1 to decrease the refrigerant flow rate (ST205-1) to increase the degree of superheat (ST206-1). If the calculated value of the degree of superheat is higher than the target value, the controller 120 increases the opening degree of the second flow control valve 105 at ST205-2 to increase the refrigerant flow rate (ST107-2) to decrease the degree of superheat (ST207-2). The controller 120 periodically repeats the control from ST201 to ST207 to control the degree of superheat in the state f at the outlet of the first evaporator 106.

The control target value for the second flow control valve 105 is not limited to the degree of superheat at the outlet of the first evaporator 106, and another physical quantity (quality or temperature) may be used for the control. In addition, the control target value is not limited to the physical quantity at the outlet of the first evaporator 106, and a degree of suction superheat or a discharge temperature of the compressor 101 which has a correlation with the physical quantity at the outlet of the first evaporator 106 may be used for the control.

Figure 8:
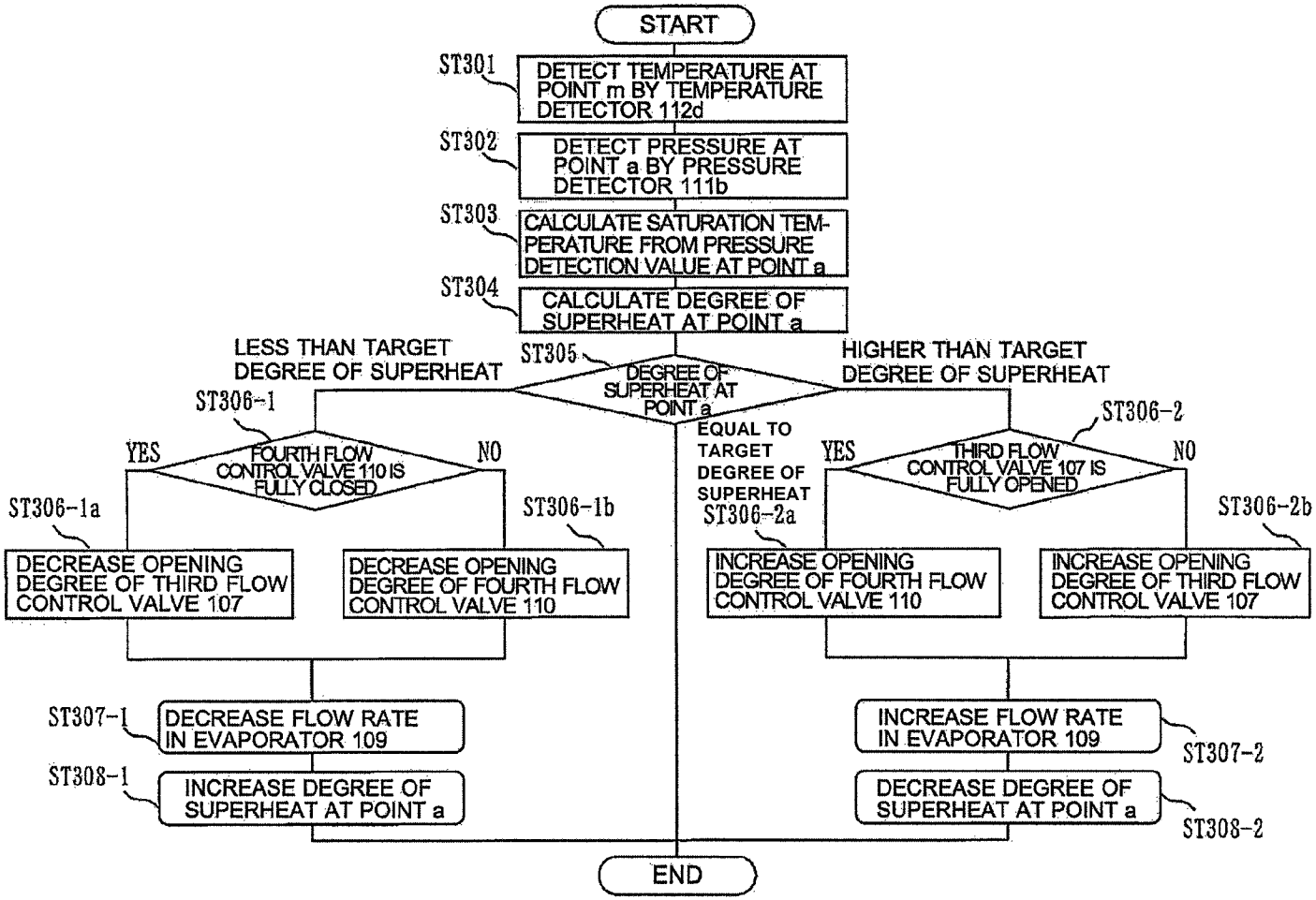
FIG. 8 is a control flow diagram of a third flow control valve 107 and a fourth flow control valve 110 of Embodiment 1.

FIG. 8 is a control flow of the third flow control valve 107 and the fourth flow control valve 110 by the controller 120. The third flow control valve 107 and the fourth flow control valve 110 are controlled through only the control flow in FIG. 8. For example, although the controller 120 determines at later-described ST306-1 whether the fourth flow control valve 110 is fully closed, the fourth flow control valve 110 is set so as to be fully closed and the third flow control valve 107 is set to a predetermined opening degree at which the third flow control valve 107 is not fully opened, in an initial state (e.g., at start of operation of the refrigeration cycle apparatus 100).

Next, control of the third flow control valve 107 and the fourth flow control valve 110 will be described with reference to FIG. 8. Operations of the third flow control valve 107 and the fourth flow control valve 110 are characterized in that when the fourth flow control valve 110 is in a closed state, the third flow control valve 107 performs an opening/closing operation, and when the third flow control valve 107 is in a fully-opened state, the fourth flow control valve 110 performs an opening/closing operation.

The control of the third flow control valve 107 and the fourth flow control valve 110 will be described with, as an example, the case where a degree of superheat at the outlet of the second evaporator 109 (at the point m) is a target value.

At ST301, the temperature at the outlet of the second evaporator 109 is detected via the temperature detector 112*d*. At ST302, the pressure in the state a is detected by the pressure detector 111*b*. At ST303, the controller 120 calculates the saturation temperature of the refrigerant according to a predetermined degree-of-superheat calculation rule from the pressure detection value at ST302. At ST304, the controller 120 calculates the degree of superheat at the outlet of the second evaporator 109 using the temperature detection value at ST301 and the calculated value of the refrigerant saturation temperature at ST303 (temperature detection value−refrigerant saturation temperature). The predetermined degree-of-superheat calculation rule includes this calculation. The controller 120 determines the calculated value of the degree of superheat at ST305 and controls the opening degrees of the third flow control valve 107 and the fourth flow control valve 110.

If the calculated value of the degree of superheat at ST303 is lower than the target value, the controller 120 checks the opening degree of the fourth flow control valve 110 at ST306-1. If the fourth flow control valve 110 is fully closed, the controller 120 decreases the opening degree of the third flow control valve 107 (ST306-1*a*). If the fourth flow control valve 110 is opened and the refrigerant flows to the bypass circuit 113, the controller 120 decreases the opening degree of the fourth flow control valve 110 (ST306-1*b*). Through the operation at ST306-1*a* or ST306-1*b*, the flow rate of the refrigerant in the second evaporator 109 decreases (ST307-1), and the degree of superheat at the outlet of the second evaporator 109 increases (ST308-1).

On the other hand, if the degree of superheat at the outlet of the second evaporator 109 is higher than the target value at ST305, the controller 120 checks the opening degree of the third flow control valve 107 at ST306-2. If the third flow control valve 107 is fully opened, the controller 120 increases the opening degree of the fourth flow control valve 110 (ST306-2*a*). If the third flow control valve 107 is not fully opened, the controller 120 increases the opening degree of the third flow control valve 107 (ST306-2*b*). Through the operation at ST306-2*a* or ST306-2*b*, the flow rate of the refrigerant in the second evaporator 109 increases (ST307-2), and the degree of superheat at the outlet of the second evaporator 109 decreases (ST308-2).

In the embodiment described above, the degree of superheat at the outlet of the second evaporator 109 is used as the control target value for the third flow control valve 107 and the fourth flow control valve 110. However, the degree of suction superheat of the compressor 101 or the temperature on the discharge side of the compressor 101 may be controlled as a predetermined target value.

Figure 9:
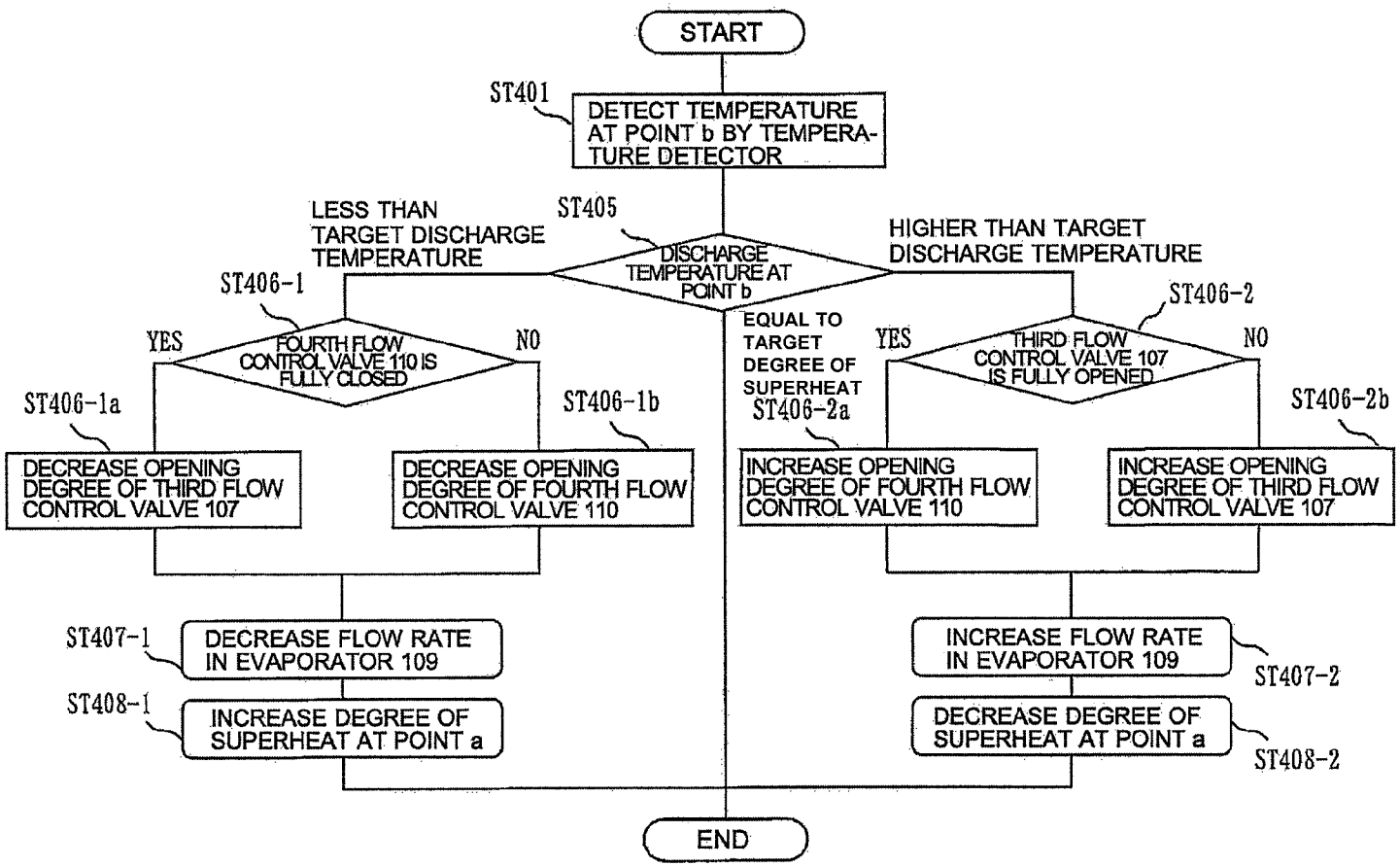
FIG. 9 is another control flow diagram of the third flow control valve 107 and the fourth flow control valve 110 of Embodiment 1.

FIG. 9 is a control flow through which the controller 120 controls the third flow control valve 107 and the fourth flow control valve 110 on the basis of the temperature on the discharge side. The operations at and after ST405 in FIG. 9 are the same as those in FIG. 8. Only ST401 in FIG. 9 is different from FIG. 8. That is, in the case of FIG. 9 in which the third flow control valve 107 and the fourth flow control valve 110 are controlled on the basis of the temperature on the discharge side, the controller 120 applies a predetermined discharge temperature calculation rule to a detection result of a temperature detector (not shown) which detects a discharge temperature of the compressor 101, to calculate a discharge temperature at ST401. Then, at ST405, the controller 120 compares and determines a previously-held target discharge temperature and the discharge temperature calculation result. If the calculated value is less than the target discharge temperature, the processing proceeds to ST406-1. If the calculated value is equal to the target discharge temperature, the processing ends. If the calculated value is higher than the target discharge temperature, the processing proceeds to ST406-2. The subsequent processing is the same as that in FIG. 8.

The advantageous effects of Embodiment 1 will be described with reference to FIGS. 10, 11, and 12.

Figure 10:
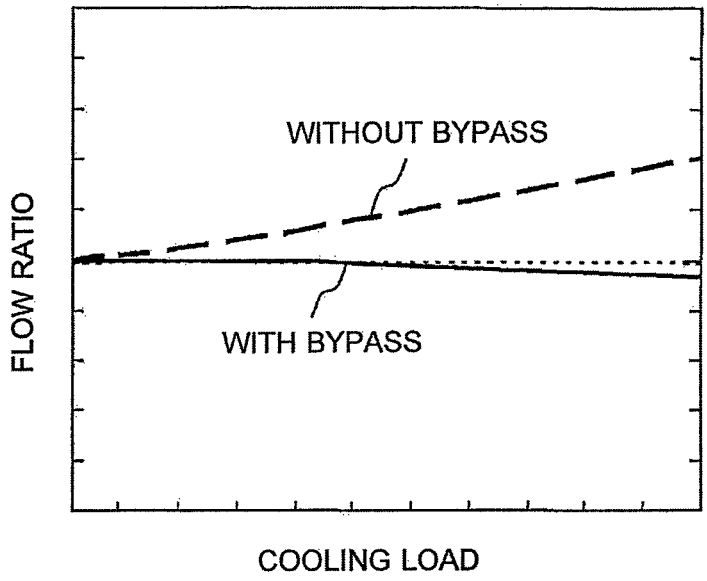
FIG. 10 is a diagram of the relationship between a cooling load and a refrigerant flow ratio of the refrigeration cycle apparatus 100 of Embodiment 1.

FIG. 10 is a diagram of the relationship between the cooling load and a refrigerant flow ratio of the refrigeration cycle apparatus 100. In FIG. 10, the horizontal axis indicates the cooling load, and the vertical axis indicates the refrigerant flow ratio (the refrigerant flow rate of the first evaporator 106/the discharge refrigerant flow rate of the compressor 101). When the bypass circuit 113 is not used, the flow ratio increases with increase of the cooling load. On the other hand, when the bypass circuit 113 is used, the refrigerant flow ratio can be stabilized with respect to the cooling load.

Figure 11:
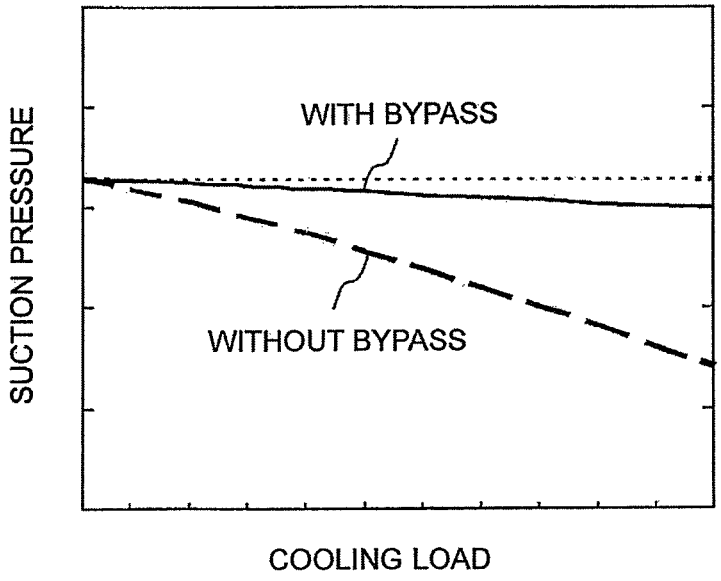
FIG. 11 is a diagram of the relationship between the cooling load and a suction pressure of the refrigeration cycle apparatus 100 of Embodiment 1.

FIG. 11 is a diagram of the relationship between the cooling load and a suction pressure of the refrigeration cycle apparatus 100. The horizontal axis indicates the cooling load, and the vertical axis indicates the suction pressure of the compressor 101. When the bypass circuit 113 is used, the refrigerant flow rate of the first evaporator 106 is adjusted to an appropriate value, and thus reduction of the suction pressure of the compressor 101 can be suppressed as compared to the case where the bypass is not used.

Figure 12:
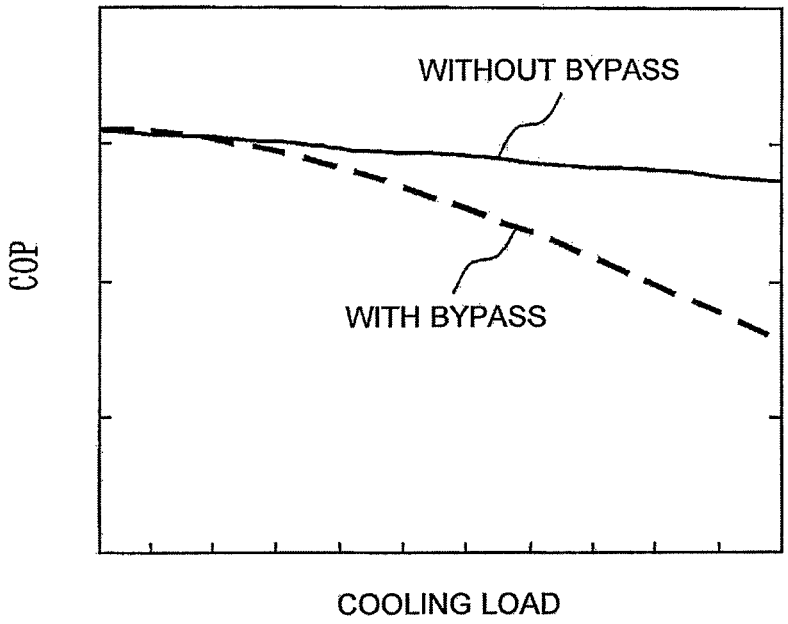
FIG. 12 is a diagram of the relationship between the cooling load and a COP suction pressure of the refrigeration cycle apparatus 100 of Embodiment 1.

As a result, as shown in FIG. 12 which is a diagram of the relationship between the cooling load and a COP suction pressure of the refrigeration cycle apparatus 100, a high COP can be obtained as compared to the case where there is no bypass circuit.

The refrigerant used for the refrigeration cycle apparatus 100 of Embodiment 1 is not limited to a fluorocarbon refrigerant such as R410A and R32, and carbon dioxide or a hydrocarbon refrigerant such as propane and isobutane may be used. With either refrigerant, the same advantageous effects as those in Embodiment 1 can be obtained. Although propane is a flammable refrigerant, the refrigeration cycle apparatus can be used with high safety when the evaporator and the condenser are accommodated in the same housing and installed at a location away from the cooling space; water is circulated through the evaporator; and cold water is used for cooling. In addition, even when a HFO (hydrofluoroolefin) refrigerant, which is a low GWP (Global Warming Potential) refrigerant, or a mixture thereof is used, the same advantageous effects can be obtained.

Figure 13:
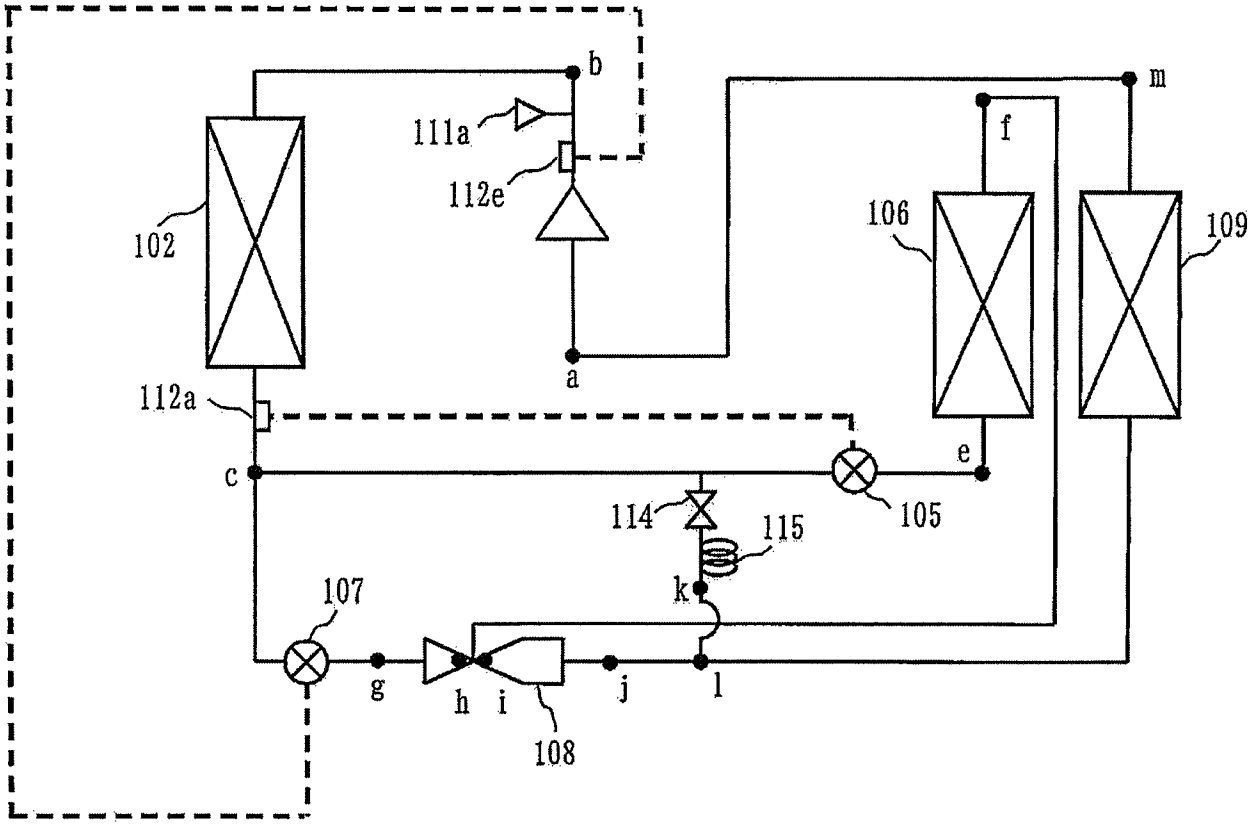
FIG. 13 is another schematic diagram of the refrigeration cycle apparatus 100 of Embodiment 1.

FIG. 13 is another schematic diagram of the refrigeration cycle apparatus 100. In FIG. 13, the fourth flow control valve 110 (an example of the bypass flow control unit) is replaced with "a configuration of an opening/closing valve 114 and a capillary pipe 115" (an example of the bypass flow control unit). Specifically, although the flow rate in the bypass circuit 113 is adjusted by the fourth flow control valve 110 in FIG. 1, the opening/closing valve 114 (whose opening/closing is controllable by the controller 120) and the capillary pipe 115 may be used to constitute a bypass flow control unit which performs flow control instead of the fourth flow control valve 110, as shown in FIG. 13, for the purpose of cost reduction.

In addition, in FIG. 13, "the first flow control valve 103 and the refrigerant storage container 104" are removed. "The first flow control valve 103 and the refrigerant storage container 104" may be removed from the refrigeration cycle apparatus 100 in FIG. 1, and the bypass circuit 113 may be provided on the upstream side of the second flow control valve 105. In this case as well, the same advantageous effects can be obtained.

(Needle Valve)

Figure 14:
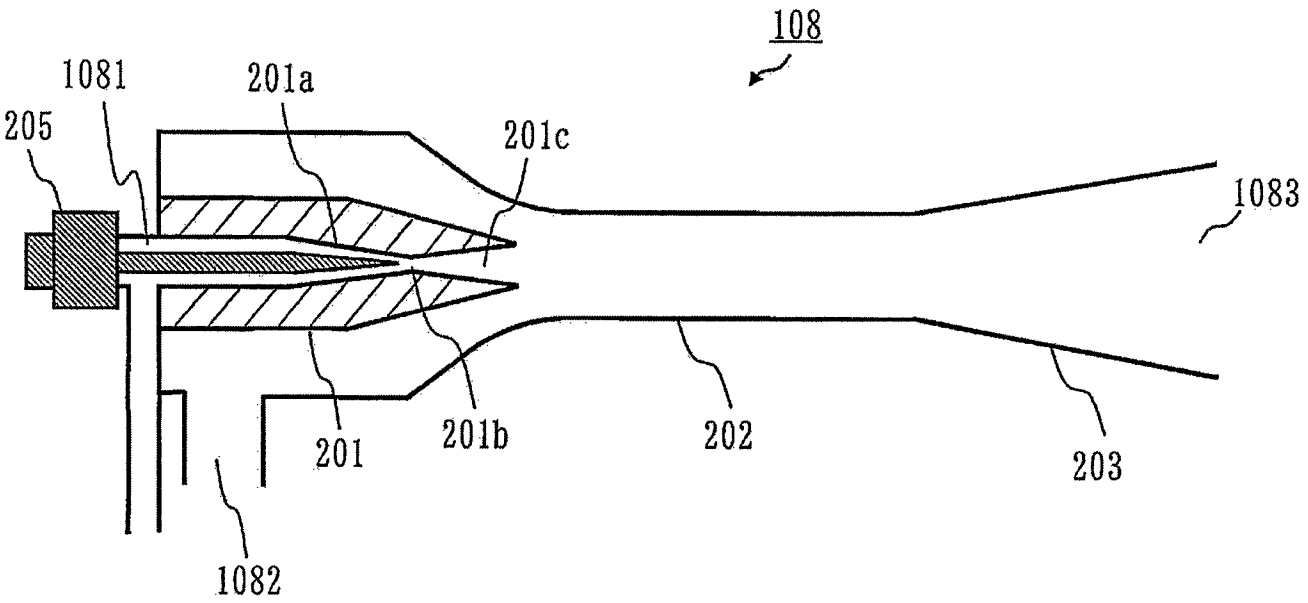
FIG. 14 is an overall diagram of a needle valve-equipped ejector 108 of Embodiment 1.

FIG. 14 shows an overall diagram of a needle valve-equipped ejector.

Figure 15:
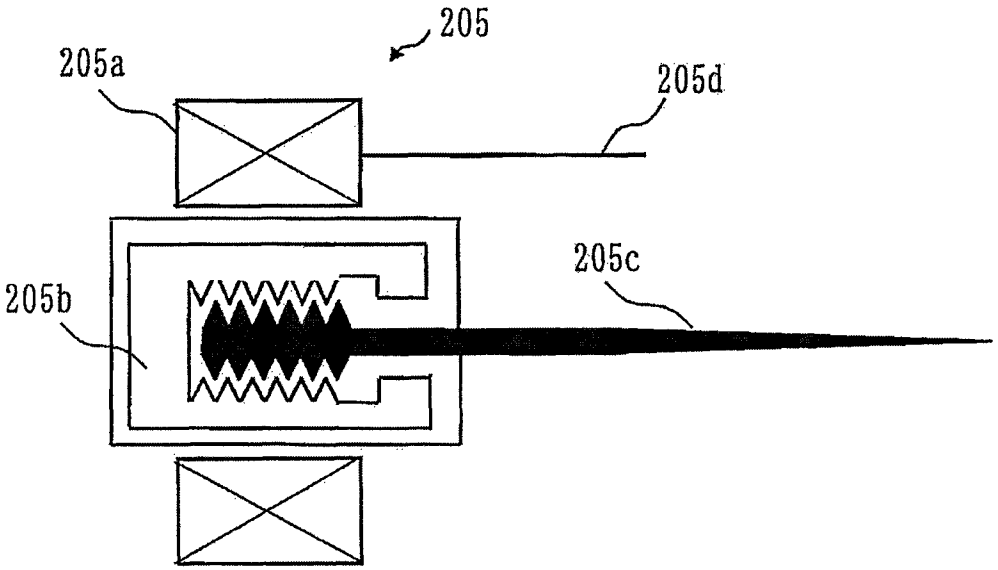
FIG. 15 is a configuration diagram of a needle valve 205 of Embodiment 1.

FIG. 15 shows the structure of a needle valve 205. In FIG. 1, the third flow control valve 107 is provided on the upstream side of the ejector 108. However, as shown in FIG. 14, an ejector having a structure in which the ejector 108 and the movable needle valve 205 (an example of the driving flow control unit) are integrated may be used to replace the third flow control valve 107.

As shown in FIG. 15, the needle valve 205 includes a coil portion 205*a*, a rotor portion 205*b*, and a needle portion 205*c*. Upon receipt of a pulse signal from the control signal transmission section (not shown in the previous drawings) of the controller 120 via a signal cable 205*d*, the coil portion 205*a* generates a magnetic pole, and the rotor portion 205*b* within the coil rotates. As a rotation shaft of the rotor portion 205*b*, a screw and a needle are machined, and rotation of the screw produces axial movement, whereby the needle portion 205*c* moves. The needle valve 205 has a structure in which the needle portion 205*c* is movable in the left/right direction in FIG. 15 to adjust a rate of driving flow from the condenser 102. Due to this structure, the function of the third flow control valve 107 can be replaced with the movable needle valve 205.

As described above, the needle valve 205 serves as the driving flow control unit since the amount by which the needle valve 205 is inserted into the driving refrigerant inlet 1081 of the ejector 108 is changed under control of the controller 1220. Thus, the ejector 108 and the third flow control valve 107 can be structurally integrated, hence a pipe connecting both components is eliminated, and the cost can be reduced.

The refrigeration cycle apparatus 100 according to Embodiment 1 described above may be used not only in an air-conditioning apparatus but also in a water heating apparatus having an air heat source and using a water heat exchanger as a condenser, a chiller or a brine cooler having an air heat source and using a water heat exchanger as an evaporator, and further a heat pump chiller using water heat exchangers as an evaporator and a condenser.

According to the refrigeration cycle apparatus of Embodiment 1, a refrigeration cycle apparatus using an ejector can be provided as a refrigeration cycle apparatus which is operable with high efficiency by the ejector even when an operating condition is deviated from an appropriate operating condition of the ejector.

The refrigeration cycle apparatus 100 of Embodiment 1 uses the first flow control valve 103 to adjust the flow rate to the first evaporator 106 when the cooling load is low and the refrigerant flow rate to the ejector is excessively high. When the cooling load is high and the refrigerant flow rate to the ejector 108 is excessively low, the refrigeration cycle apparatus 100 uses the fourth flow control valve 110 to adjust the flow rate to the first evaporator, whereby a working state of the refrigeration cycle in which the COP is at its maximum can be provided and an energy-saving operation of the refrigeration cycle can be achieved.

Although the refrigeration cycle apparatus has been described in Embodiment 1, it is possible to recognize the refrigeration cycle apparatus as the following refrigerant circulating method.

Specifically, a refrigerant circulating method for circulating a refrigerant by using an ejector having a driving refrigerant inlet into which a driving refrigerant flows, a suction refrigerant inlet into which a suction refrigerant flows, and a mixed refrigerant outlet through which a mixed refrigerant which is a mixture of the driving refrigerant and the suction refrigerant flows out, includes:

forming a first refrigerant path in which a compressor, a radiator, a flow control valve, and a first evaporator are connected in this order via pipes and a refrigerant outlet of the first evaporator is connected to the suction refrigerant inlet of the ejector via a pipe;

forming a second refrigerant path in which the compressor and a second evaporator are connected in this order via a pipe and a refrigerant inlet of the second evaporator is connected to the mixed refrigerant outlet of the ejector via a pipe;

forming a third refrigerant path which branches from a branch portion in a middle of a pipe connecting a refrigerant outlet of the radiator and the flow control valve in the first refrigerant path and is connected to the driving refrigerant inlet of the ejector via a pipe; and forming a bypass which branches from an upstream side of the flow control valve in the first refrigerant path on a downstream side of the branch portion on the first refrigerant path and is connected between the mixed refrigerant outlet of the ejector and the second evaporator via a pipe in the second refrigerant path and on which a bypass flow control unit is provided which controls a flow rate of the refrigerant, thereby circulating the refrigerant.

REFERENCE SIGNS LIST

100: refrigeration cycle apparatus, 101: compressor, 102: condenser, 103: first flow control valve, 104: refrigerant storage container, 105: second flow control valve, 106: first evaporator, 107: third flow control valve, 108: ejector, 109: second evaporator, 110: fourth flow control valve, 111*a*, 111*b*: pressure detector, 112*a*, 112*b*, 112*c*, 112*d*: temperature detector, 113: bypass circuit, 114: opening/closing valve, 115: capillary pipe, 116: branch portion, 120: controller, 201: nozzle portion, 201*a*: throttle portion, 201*b*: throat portion, 201*c*: spreading-out portion, 202: mixing portion, 203: diffuser portion, 204: suction portion, 205: needle valve, 205*a*: coil portion, 205*b*: rotor portion, 205*c*: needle portion, 205*d*: signal cable

The invention claimed is:

1. A refrigeration cycle apparatus, for circulating a refrigerant, including an ejector having a driving refrigerant inlet into which a driving refrigerant flows, a suction refrigerant inlet into which a suction refrigerant flows, and a mixed refrigerant outlet through which a mixed refrigerant which is a mixture of the driving refrigerant and the suction refrigerant flows out, the refrigeration cycle apparatus comprising:

a first refrigerant path in which a discharge side of a compressor, a condenser, a first flow control valve, a refrigerant storage container which stores excess refrigerant, a second flow control valve, and a first evaporator are connected in this order via pipes and a refrigerant outlet of the first evaporator is connected to the suction refrigerant inlet of the ejector via a first pipe;

a second refrigerant path in which the mixed refrigerant outlet of the ejector, a second evaporator, and a refrigerant inlet side of the compressor are connected in this order via pipes;

a third refrigerant path which branches from a branch portion in a middle of a pipe connecting a refrigerant outlet of the condenser and the first flow control valve in the first refrigerant path and is connected to the driving refrigerant inlet of the ejector via a third pipe;

a bypass which branches from a downstream side of the refrigerant storage container and an upstream side of the second flow control valve in the first refrigerant path on a downstream side of the branch portion and is connected between the mixed refrigerant outlet of the ejector and the second evaporator via a bypass pipe in the second refrigerant path and a bypass flow control unit is provided in a middle of the bypass pipe, which controls a flow rate of the refrigerant; and a driving flow control unit which adjusts a flow rate of the refrigerant flowing as the driving refrigerant into the driving refrigerant inlet of the ejector via the third refrigerant path; and a controller which controls the opening degrees of the driving flow control unit and the bypass flow control unit, wherein opening degrees of the driving flow control unit and the bypass flow control unit are controlled to control a flow rate of the refrigerant, and the controller determines the opening degree of the bypass flow control unit, and controls the opening degree of the driving flow control unit if determining that the opening degree of the bypass flow control unit is in a closed state.

2. The refrigeration cycle apparatus of claim 1, wherein the controller calculates a current degree of superheat of the refrigerant at a predetermined location on the second refrigerant path according to a predetermined degree-of-superheat calculation rule, and controls the opening degree of at least either the driving flow control unit or the bypass flow control unit on the basis of the calculated degree of superheat.

3. The refrigeration cycle apparatus of claim 1, wherein the controller calculates a discharge temperature of the refrigerant from the compressor according to a predetermined discharge temperature calculation rule based on an output of a temperature detector, and controls the opening degree of at least either the driving flow control unit or the bypass flow control unit on the basis of the calculated discharge temperature.

4. The refrigeration cycle apparatus of claim 1, wherein the bypass flow control unit includes an opening/closing valve and a capillary pipe.

5. The refrigeration cycle apparatus of claim 1, wherein the driving flow control unit is realized by a needle valve whose insertion amount into the driving refrigerant inlet of the ejector is changed under control of the controller.

6. The refrigeration cycle apparatus of claim 1, wherein the refrigeration cycle apparatus uses any of a fluorocarbon refrigerant, a hydrocarbon refrigerant, or a HFO refrigerant as the refrigerant.

7. The refrigeration cycle apparatus of claim 1, wherein the controller calculates a discharge temperature of the refrigerant from the compressor based on an output of a temperature detector.

8. The refrigeration cycle apparatus of claim 1, wherein the refrigerant storage container, which connects the first refrigerant path to the second refrigerant path, is configured to separate a stored refrigerant based on density.

9. The refrigeration cycle apparatus of claim 1, wherein the bypass is configured to decrease an enthalpy of the mixed refrigerant flowing out of the mixed refrigerant outlet of the ejector.

10. A refrigeration cycle apparatus, for circulating a refrigerant, including an ejector having a driving refrigerant inlet into which a driving refrigerant flows, a suction refrigerant inlet into which a suction refrigerant flows, and a mixed refrigerant outlet through which a mixed refrigerant which is a mixture of the driving refrigerant and the suction refrigerant flows out, the refrigeration cycle apparatus comprising:

a first refrigerant path in which a discharge side of a compressor, a condenser, a first flow control valve, a refrigerant storage container which stores excess refrigerant, a second flow control valve, and a first evaporator are connected in this order via pipes and a refrigerant outlet of the first evaporator is connected to the suction refrigerant inlet of the ejector via a first pipe;

a second refrigerant path in which the mixed refrigerant outlet of the ejector, a second evaporator, and a refrigerant inlet side of the compressor are connected in this order via pipes;

a third refrigerant path which branches from a branch portion in a middle of a pipe connecting a refrigerant outlet of the condenser and the first flow control valve in the first refrigerant path and is connected to the driving refrigerant inlet of the ejector via a third pipe;

a bypass which branches from a downstream side of the refrigerant storage container and an upstream side of the second flow control valve in the first refrigerant path on a downstream side of the branch portion and is connected between the mixed refrigerant outlet of the ejector and the second evaporator via a bypass pipe in the second refrigerant path and a bypass flow control unit is provided in a middle of the bypass pipe, which controls a flow rate of the refrigerant;

a driving flow control unit which adjusts a flow rate of the refrigerant flowing as the driving refrigerant into the driving refrigerant inlet of the ejector via the third refrigerant path; and a controller which controls the opening degrees of the driving flow control unit and the bypass flow control unit, wherein opening degrees of the driving flow control unit and the bypass flow control unit are controlled to control a flow rate of the refrigerant, and the controller determines the opening degree of the driving flow control unit, and controls the opening degree of the bypass flow control unit if determining that the opening degree of the driving flow control unit is in a fully-opened state.

11. The refrigeration cycle apparatus of claim 10, wherein the controller calculates a current degree of superheat of the refrigerant at a predetermined location on the second refrigerant path according to a predetermined degree-of-superheat calculation rule, and controls the opening degree of at least either the driving flow control unit or the bypass flow control unit on the basis of the calculated degree of superheat.

12. The refrigeration cycle apparatus of claim 10, wherein the controller calculates a discharge temperature of the refrigerant from the compressor according to a predetermined discharge temperature calculation rule based on an output of a temperature detector, and controls the opening degree of at least either the driving flow control unit or the bypass flow control unit on the basis of the calculated discharge temperature.

13. The refrigeration cycle apparatus of claim 10, wherein the bypass flow control unit includes an opening/closing valve and a capillary pipe.

14. The refrigeration cycle apparatus of claim 10, wherein the driving flow control unit is realized by a needle valve whose insertion amount into the driving refrigerant inlet of the ejector is changed under control of the controller.

15. The refrigeration cycle apparatus of claim 10, wherein the refrigeration cycle apparatus uses any of a fluorocarbon refrigerant, a hydrocarbon refrigerant, or a HFO refrigerant as the refrigerant.

16. The refrigeration cycle apparatus of claim 10, wherein the bypass is configured to decrease an enthalpy of the mixed refrigerant flowing out of the mixed refrigerant outlet of the ejector.

* * * * *